US008689486B2

(12) United States Patent
Menning

(10) Patent No.: US 8,689,486 B2
(45) Date of Patent: Apr. 8, 2014

(54) BARRIER OPERATOR AND CHASSIS

(75) Inventor: Curtis P. Menning, Palatine, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 13/556,694

(22) Filed: Jul. 24, 2012

(65) Prior Publication Data

US 2014/0027391 A1 Jan. 30, 2014

(51) Int. Cl.
*E05F 15/00* (2006.01)

(52) U.S. Cl.
USPC ..... 49/199; 160/188; 310/89

(58) Field of Classification Search
USPC ..... 160/188, 189; 49/199, 200; 310/89
See application file for complete search history.

(56) References Cited

U.S. PATENT DOCUMENTS

| | | | | | |
|---|---|---|---|---|---|
| 2,736,553 | A | * | 2/1956 | Brown | 160/188 |
| 3,252,503 | A | * | 5/1966 | Jackson | 160/193 |
| 3,874,117 | A | | 4/1975 | Boehm | |
| 3,996,697 | A | * | 12/1976 | Bailey et al. | 49/28 |
| 4,131,830 | A | * | 12/1978 | Lee et al. | 318/266 |
| 4,147,073 | A | * | 4/1979 | Mercier | 74/424.78 |
| 4,191,237 | A | | 3/1980 | Voege | |
| 4,344,252 | A | * | 8/1982 | Suzuki et al. | 49/199 |
| 4,386,398 | A | * | 5/1983 | Matsuoka et al. | 700/90 |
| 4,520,684 | A | * | 6/1985 | Meyer et al. | 74/89.21 |
| 4,628,636 | A | * | 12/1986 | Folger | 49/199 |
| 4,653,565 | A | * | 3/1987 | Iha et al. | 160/193 |
| 5,010,688 | A | | 4/1991 | Dombrowski et al. | |
| 5,221,239 | A | | 6/1993 | Catlett | |
| 5,221,869 | A | * | 6/1993 | Williams et al. | 310/83 |
| 5,708,340 | A | | 1/1998 | Chang | |
| 5,761,850 | A | | 6/1998 | Lhotak et al. | |
| 5,936,842 | A | * | 8/1999 | Kaiser et al. | 361/752 |
| 6,051,947 | A | * | 4/2000 | Lhotak et al. | 318/445 |
| 6,118,243 | A | * | 9/2000 | Reed et al. | 318/468 |
| 6,414,454 | B1 | | 7/2002 | Lhotak et al. | |
| 7,294,945 | B2 | * | 11/2007 | Hormann | 310/89 |
| 7,432,676 | B2 | | 10/2008 | Keller et al. | |
| 2004/0020612 | A1 | * | 2/2004 | Bosio | 160/188 |
| 2007/0051045 | A1 | * | 3/2007 | Hoermann | 49/199 |
| 2010/0031574 | A1 | | 2/2010 | Hormann | |
| 2012/0299698 | A1 | * | 11/2012 | Krupke et al. | 340/5.7 |

OTHER PUBLICATIONS

Chamberlain Power Drive; Garage Door Opener Assembly/Installation Manual; © 2008, The Chamberlain Group.

* cited by examiner

*Primary Examiner* — David Purol
(74) *Attorney, Agent, or Firm* — Fitch Even Tabin & Flannery LLP

(57) ABSTRACT

A chassis for a barrier operator is provided. The barrier operator includes a motor and a transmission configured to cooperate with a rail system to move a barrier. The chassis includes a unibody frame having a first portion, a second portion, and a third portion. The first portion is configured to receive and secure the motor to the unibody frame. The second portion is configured to receive and secure the transmission to the unibody frame. The third portion is configured to receive and secure at least a portion of the rail system to the unibody frame. The first, second, and third portions are formed as a single, integral component.

37 Claims, 9 Drawing Sheets

BARRIER OPERATOR AND CHASSIS

FIELD

The present application relates to movable barriers such as overhead doors and the like, particularly barrier operators in which a drive force is applied to the overhead door by a motor.

BACKGROUND

Barrier operators and the associated systems may be used to operate movable barriers, such as, for example, garage doors and overhead doors. Generally, barrier operators include a motor and a transmission which cooperate with a rail system to move the doors. In this regard, the barrier operator may include a motor and/or transmission as one or more components that may be connected to a chassis of the barrier operator such as through the use of one or more adapters or coupling devices. Similarly, the rail system may be operably coupled to the motor and transmission through the chassis and the use of further adapters or coupling devices.

However, in such systems, the assembly time and/or installation time of barrier operators may be problematic. For example, in one form, the barrier operator may be manufactured such that many of the components are preassembled, including the motor and transmission. However, this may increase overall manufacturing time and costs. Further, even though the barrier operator may be substantially preassembled, the barrier operator may need further modifications to accommodate specific installations and/or rail systems. In this regard, the installer may require additional tools or additional hardware for installation. Alternatively, some of the components of the barrier operator, such as the motor, transmission, couplers, and the like, may be manufactured such that the installer may have to assemble a substantial portion of the barrier operator at the installation location. However, this adds further time to the installation.

Moreover, traditional barrier operators and their associated support structure are generally constructed of multiple components such that the components are coupled together during manufacturing and/or installation. In this regard, the barrier operator may include a multi-component chassis that includes a motor adapter, transmission adapter, rail adapter, and the like. However, each of these multiple components may cause the overall barrier operator to be large and heavy.

Additionally, traditional barrier operators are configured to receive a single rail system. For example, the barrier operator may be designed to accept only one of a C-rail system, T-rail system, or SSR system. Alternatively, the barrier operator may be heavily modified, such as during installation, to accept a different rail system than was originally designed. However, such modifications may require extensive use of couplers and adapters that may introduce weak points in the connection and otherwise increase parts and installation costs.

Finally, because of the multi-component configurations of barrier operators, along with the need for numerous adapters and couplers, the overall size of the barrier operator may be large such that the appearance and/or enclosure for the barrier operator may be somewhat limited. For example, because of the configuration of the motor location, the transmission, and the design of the chassis, the enclosure for the barrier operator may be somewhat limited in how the enclosure is attached to the barrier operator and what features are covered by the enclosure.

SUMMARY

According to one form, a chassis for a barrier operator is provided. The barrier operator includes a motor and a transmission configured to cooperate with a rail system to move a barrier. The chassis includes a unibody frame having a first portion, a second portion, and a third portion. The first portion is configured to receive and secure the motor to the unibody frame. The second portion is configured to receive and secure the transmission to the unibody frame. The third portion is configured to receive and secure at least a portion of the rail system to the unibody frame. The first, second, and third portions are formed as a single, integral component.

In one form, a chassis for a barrier operator is provided. The barrier operator includes a motor and a transmission configured to cooperate with a rail system to move a barrier. The chassis includes a frame having a first portion, a second portion, and a third portion. The first portion is configured to receive and secure the motor to the frame. The second portion is configured to receive and secure the transmission to the frame. The third portion is configured to receive and secure at least a portion of the rail system to the frame. The third portion includes at least a first rail portion and a second rail portion. The first rail portion is configured to receive and secure a first rail system to the chassis, and the second rail portion configured to receive a second rail system different from the first rail system to the chassis. The first and second rail portions are formed as a single, integral component.

In another form, a barrier operator is provided that is configured to cooperate with a rail system to move a barrier. The barrier operator includes a motor, a transmission, and a chassis. The chassis includes a unibody frame having a first portion, a second portion, and a third portion. The first portion is configured to receive and secure the motor to the unibody frame. The second portion is configured to receive and secure the transmission to the unibody frame. The third portion is configured to receive and secure at least a portion of the rail system to the unibody frame. The first, second, and third portions are formed as a single, integral component.

In one form, a barrier operator is provided that is configured to cooperate with a rail system to move a barrier. The barrier operator includes a motor, a transmission, and a chassis. The chassis includes a unibody frame having a first portion, a second portion, and a third portion. The first portion is configured to receive and secure the motor to the unibody frame. The second portion is configured to receive and secure the transmission to the unibody frame. The third portion is configured to receive and secure at least a portion of the rail system to the unibody frame. The third portion includes at least a first rail portion defining a first rail opening and a second rail portion defining a second rail opening. The first rail opening is configured to receive and secure a first rail system to the chassis and the second rail opening configured to receive a second rail system to the chassis different from the first rail system. The first and second rail openings are interconnected to allow a portion of the first rail system to extend from the first rail opening into the second rail opening. The first, second, and third portions are formed as a single, integral component.

According to one form, an apparatus is provided including a chassis having a first flange and a second flange. The first flange includes a first flange edge integral with and defining a motor flange formed to receive and mount a motor. The first flange includes a transmission housing integral with and extending toward a first side of the chassis. The transmission housing is configured to house at least a part of a transmission and is configured to receive rotational power from the motor and provide the rotational power to a drive gear supported on a second side of the chassis opposite of the first side of the chassis. The first flange defines an aperture configured to receive a portion of the transmission to drive the drive gear.

The second flange is integral with the first flange along an edge of the first flange different from the first flange edge. The second flange defines a pair of arms on the first side of the chassis. The pair of arms defines a slot between terminal portions of each of the arms. The slot is configured to receive a first portion of a rail of a first rail system. The first portion of the rail of the first rail system, when received in the slot, is approximately perpendicular to the second flange. The second flange defines a support structure that, together with the pair of arms, defines an aperture configured to receive a second portion of the rail of the first rail system with the second portion of the rail of the first rail system oriented approximately parallel to the second flange and with an end of the rail of the first rail system approximately aligned with the drive gear. The second flange defines a C-shaped portion on the second side of the chassis. The C-shaped portion, together with the pair of arms, defines an aperture configured to receive the first portion of the rail of the first rail system and to engagingly receive a portion of a rail of a second rail system with an end of the rail of the second rail system approximately aligned with the drive gear.

In another form, the chassis further includes at least one chassis mount positioned on the unibody frame and integral therewith to secure the chassis to an external structure.

According to one form, the chassis further includes at least one body mount positioned on the unibody frame and integral therewith to secure the body to the chassis to at least partially enclose the chassis.

In one form, the third portion includes a plurality of openings, recesses, or combinations thereof configured to receive a plurality of different rail systems.

In another form, the third portion includes a first opening configured to receive a first rail system and a second opening configured to receive a second rail system, the second rail system being different from the first rail system, the first and second rail openings being interconnected to allow a portion of the first rail system to extend from the first rail opening into the second rail opening According to one form, the unibody frame is one of cast or molded as a single, integral component.

In one form, the first rail portion is configured to receive a T-rail type rail for a barrier operator system.

In another form, the second rail portion is configured to receive an SSR rail type rail for a barrier operator system.

According to one form, the barrier operator further includes a configuration of at least some of the plurality of openings, recesses, or combinations thereof configured to receive braces to define an opening configured to receive a C-rail type rail for a barrier operator system.

In one form, the first rail portion is configured to receive a T rail type rail for a barrier operator system.

In another form, the second rail portion is configured to receive an SSR rail type rail for a barrier operator system.

According to one form, the first rail portion, the second rail portion, and the configuration of at least some of the plurality of openings, recesses, or combinations thereof are arranged such that rails connected to the chassis using the first rail portion, the second rail portion, or the configuration of at least some of the plurality of openings, recesses, or combinations thereof are connected to the chassis along a common axis.

In one form, the first portion of the chassis is configured to secure a long axis of the motor parallel to the common axis of the rails.

In another form, the second portion of the chassis is located between the first portion of the chassis and the third portion of the chassis.

According to one form, the chassis defines body mount flanges that define body mount apertures configured to receive fasteners to fasten a body housing to the chassis.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
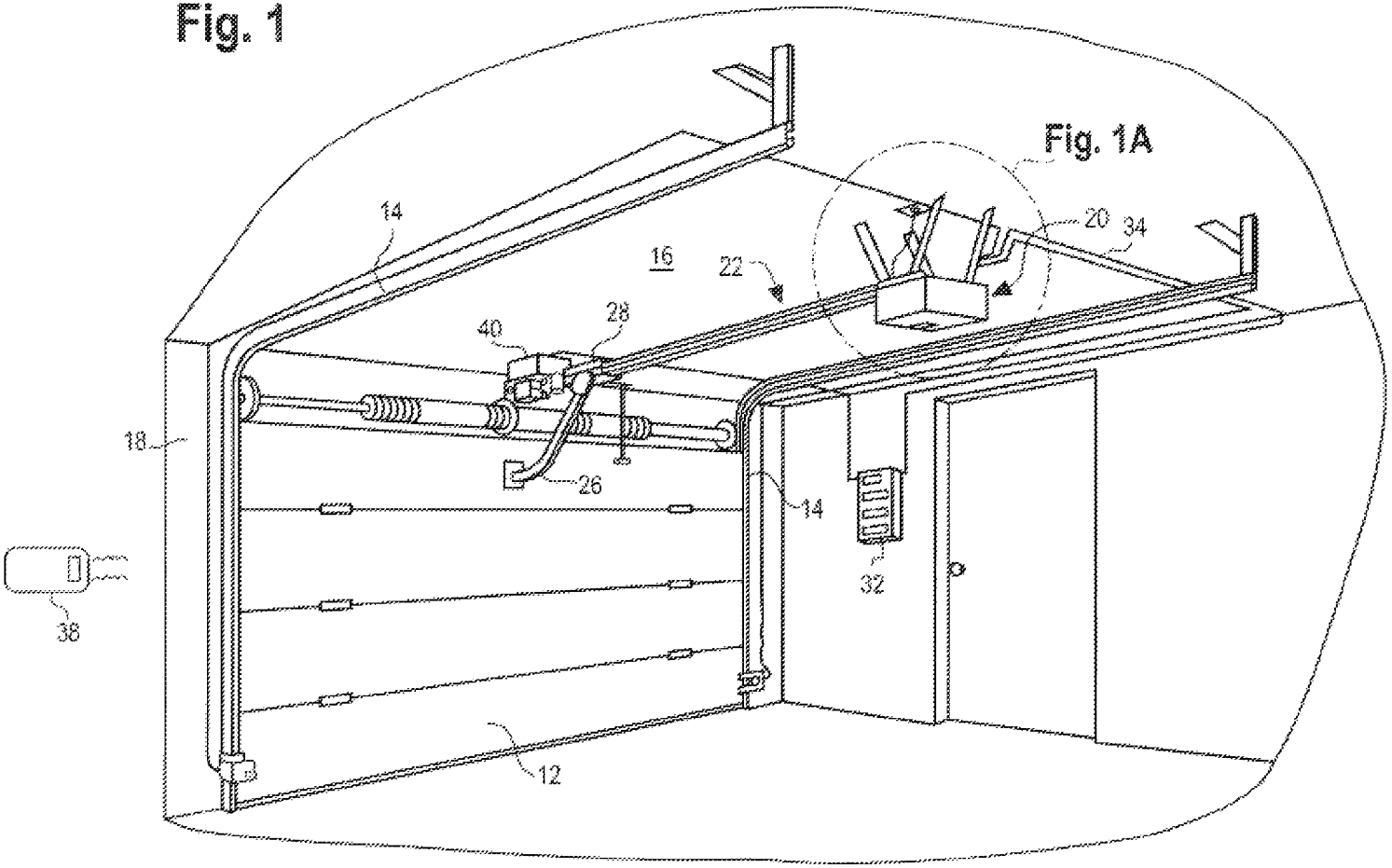
FIG. 1 is a perspective view of a barrier and barrier operating system.

Referring now to the drawings, and initially to FIG. 1, an example operator system for movable barriers is employed for controlling the opening and closing of a conventional overhead garage door 12. The garage door 12 is mounted on guide rails 14 for movement between the closed position illustrated in FIG. 1 and an open or raised position. The garage includes a ceiling 16 and a wall 18 defining an opening blocked by garage door 12. As shown, guide rails 14 are mounted to wall 18 and ceiling 16 of the garage in a conventional manner.

A barrier operator, generally indicated at 20, is mounted to ceiling 16 in a conventional manner. A drive rail 22 extends between barrier operator 20 and wall 18. As can be seen in FIG. 1, one end of drive rail 22 is mounted to a portion of wall 18 located above door 12. An operator arm 26 is connected at one end to door 12 and at the other end to a trolley 28 mounted for movement back and forth, along integrated drive rail 22. As will be seen herein, a motor in the barrier operator 20 propels trolley 28 in a desired manner to raise and lower garage door 12 via the coupling of trolley 28 and arm 26 to garage door 12.

A push button control unit 32 which in this example includes an electronic controller and a keypad is coupled by conductors 34 to the barrier operator 20 and sends signals to the power drive unit, controlling operation of the drive motor therein. Preferably, the barrier operator 20 also includes a conventional wireless receiver (not shown) for receiving wireless signals from a remote control transmitter 38. It should be noted that the barrier operator 20 may be located at any position relative to the garage door 12. For example, the barrier operator may be located at alternate position 40 shown coupled to one end of integrated drive rail 22, being mounted on wall 18, atop door 12. If desired, operational flexibility of the drive rail assembly may allow relocation of the barrier operator to a point adjacent the door.

Figure 1A:
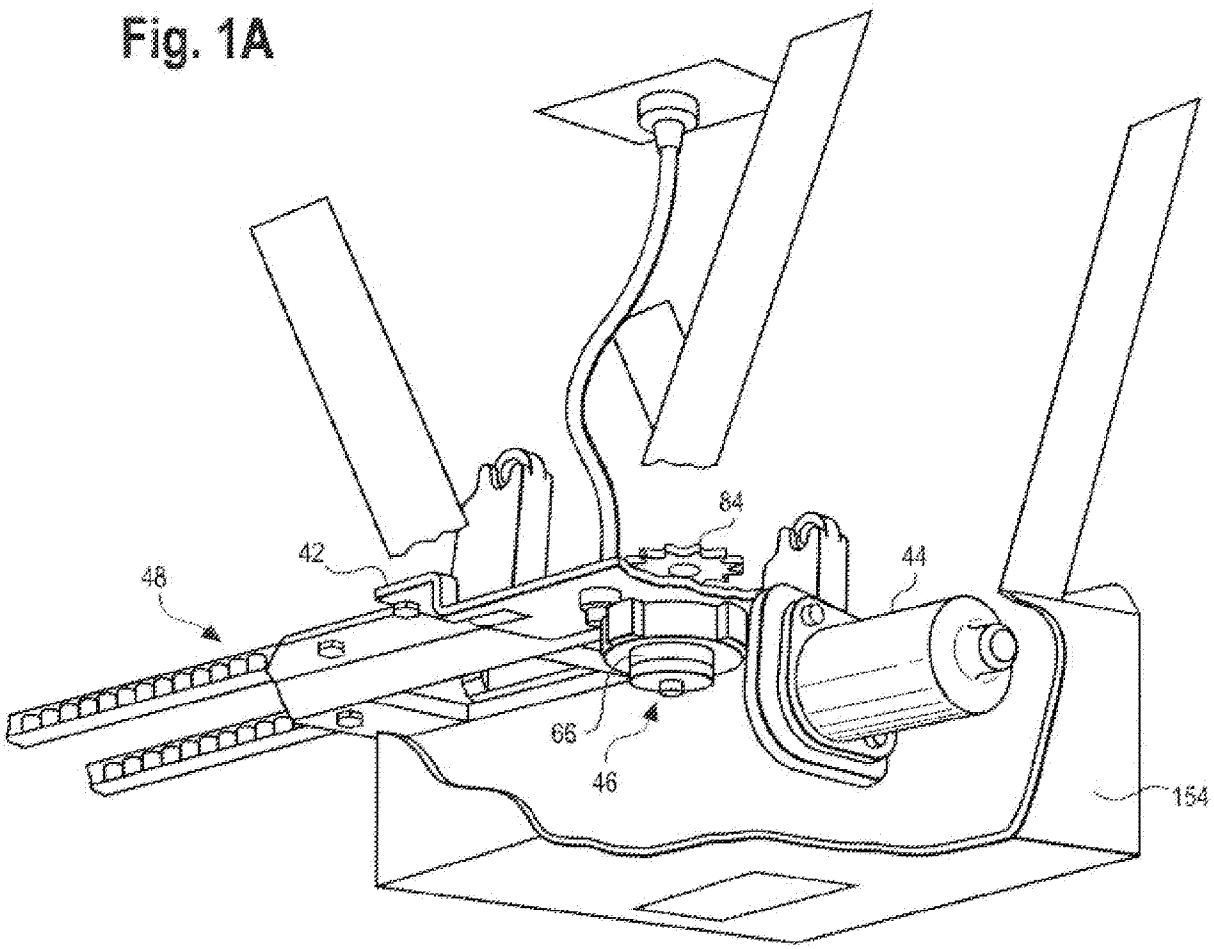
FIG. 1A is an enlarged, partial cutaway view from FIG. 1 of a portion of barrier operator.

The example barrier operator 20 will now be discussed in more detail. Referring to FIG. 1A, a partial cutaway view of barrier operator 20 is shown illustrating some of the components of the barrier operator 20 and the associated system. In one form, the barrier operator 20 includes a frame or chassis 42 that is configured to receive and secure a motor 44, a transmission 46, and at least a portion of a rail system 48 to the chassis 42.

In one form and with reference to FIGS. 2-5, the illustrated example chassis 42 includes a first portion 50 that is configured to receive and secure the motor 44 to the chassis 42. The chassis 42 also includes a second portion 52 that is configured to receive and secure the transmission 46 to the chassis 42. Additionally, the chassis 42 includes a third portion 54 that is configured to receive and secure at least a portion of the rail system 48 to the chassis 42.

The first portion 50 may be configured in a number of different manners to receive and secure the motor 44 to the chassis 42. For example, in one form, the chassis 42 includes a first flange 56 that includes a first flange edge 58 that defines a motor flange 60 that is configured to receive and mount the motor 44. In this form, the motor flange 60 defines an opening (not shown) to permit at least a portion of the motor 44, such as an output shaft 62, to pass through the opening. The output shaft 62 may include any number of different gears and the like to transfer power from the motor 44 to the transmission 46. In one form, the output shaft 62 includes a worm gear 64. The first portion 50 may also be configured such that it does not have the motor flange 60, but instead includes alternative structure to couple the motor 44 to the chassis 42. Additionally, it should be noted that the motor 44 may be coupled to the chassis 42 in any number of different manners, such as by using adapters, bolts, screws, clamps, gaskets, adhesives, and the like.

The second portion 52 may also be configured in a number of different manners to receive and secure the transmission 46 to the chassis 42. For example, in one form, the first flange 56 includes a transmission housing 66 (FIGS. 4 and 5) that extends towards a first side 68 of the chassis 42. The transmission housing 66 may be configured in a number of different manners to house at least a part of the transmission 46 and to receive rotational power from the motor 44.

For example, the transmission 46 may include any number of different gears, such as gears 70,72 and associated components, which are configured to receive rotational power from the motor 44, such as via worm gear 64. In one form, the transmission housing 66 includes a sidewall 74 and a top wall 76 that substantially enclose the transmission 46. The transmission housing 66 may also include an aperture or opening 78 (FIG. 2) that permits a portion of the transmission 46, such as a coupling portion 80, to extend through the chassis 42 to a second side 82 to provide rotational movement to a drive gear 84. In one form, the coupling portion 80 may be stabilized in the opening 78 via a bushing 85. The chassis 42 may also include any number of strengthening supports, such as support ribs 87 and wall 89 to add further rigidity, such as around the opening 78. It should be noted that, in one form, the entire transmission 46 is not enclosed in the transmission housing 66 as at least the coupling portion 80 extends externally to the transmission housing 66. It should be noted that while the drive gear 84 is illustrated in the figures as a generally sprocket-like gear, other forms of drive gears may also be utilized such as for driving chains, belts, screws, other gears and the like.

The third portion 54 may also be configured in a number of different manners to receive and secure at least a portion of the rail system 48 to the chassis 42. For example, in one form, the third portion 54 may be configured on a second flange 86. The second flange 86 may be integral with the first flange 56. Further, the second flange 86 may extend along the same axis as the first flange 56. Alternatively, the second flange 86 may extend along a parallel axis or along an entirely different angle relative to the axis of the first flange 56. In should also be noted that the third portion 54 may be configured on other structures such as the first flange 56 and the like.

Further, in one form, the third portion 54 includes any number of different slots, openings, flanges, adapters, and the like for receiving and securing at least a portion of the rail system 48. For example, in one form, referring to FIG. 2, the third portion 54 may include at least two arms 90 and a lower flange 92 defining an opening 94. Further, the arms 90 include terminal portions 96 that define a slot 98. The arms 90 may also include flanges 100 located thereon, such as adjacent the terminal portions 96 and slot 98.

The third portion 54 may also include other structures such as a C-shaped portion 102. It should be noted that the C-shaped portion 102 may take other forms such as an arc-shaped portion, V-shaped portion, circular portion, and the like to accommodate different rail systems as described in more detail below.

Figure 2:
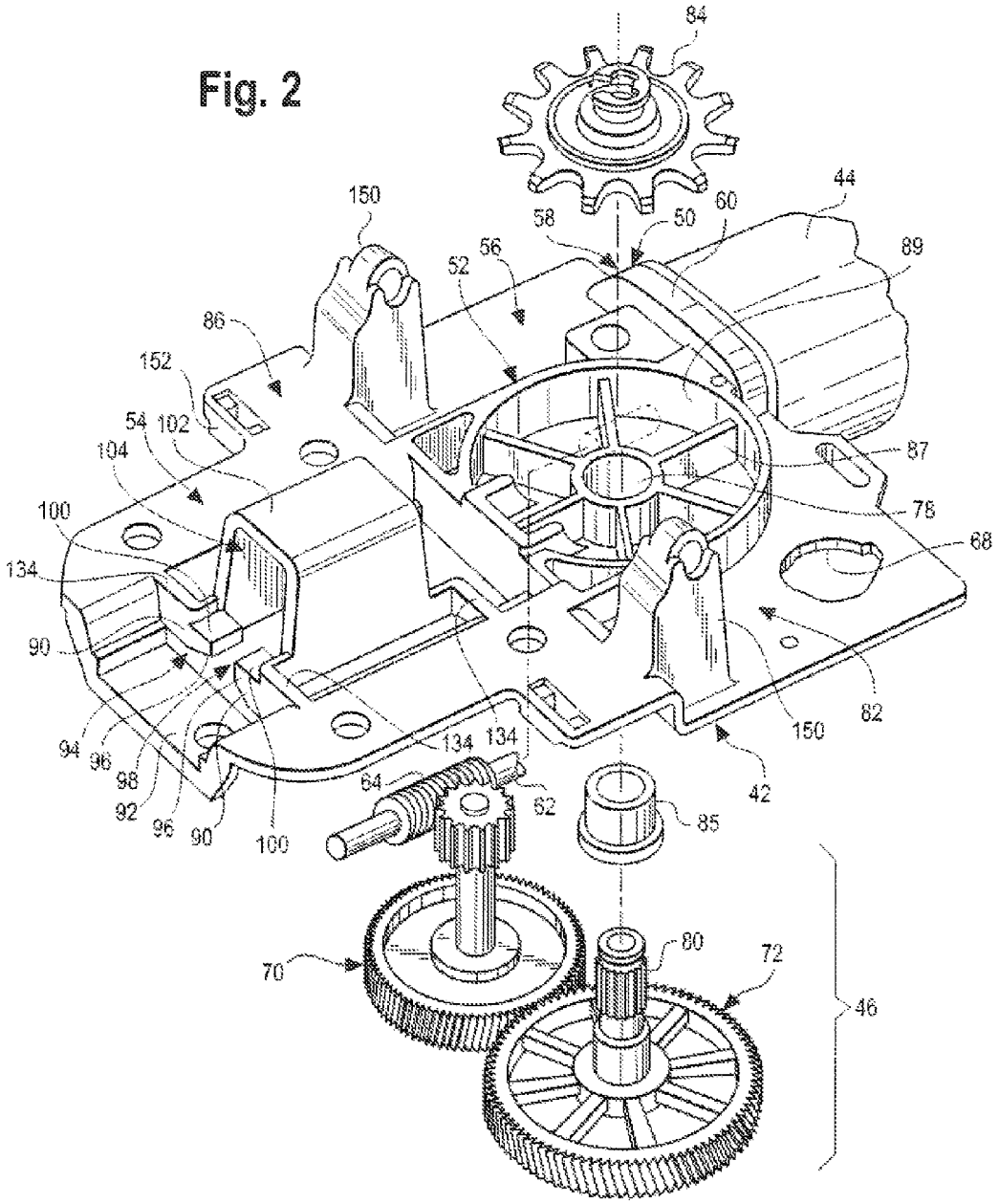
FIG. 2 is a partial exploded view of an example barrier operator chassis transmission and motor.
Figure 3:
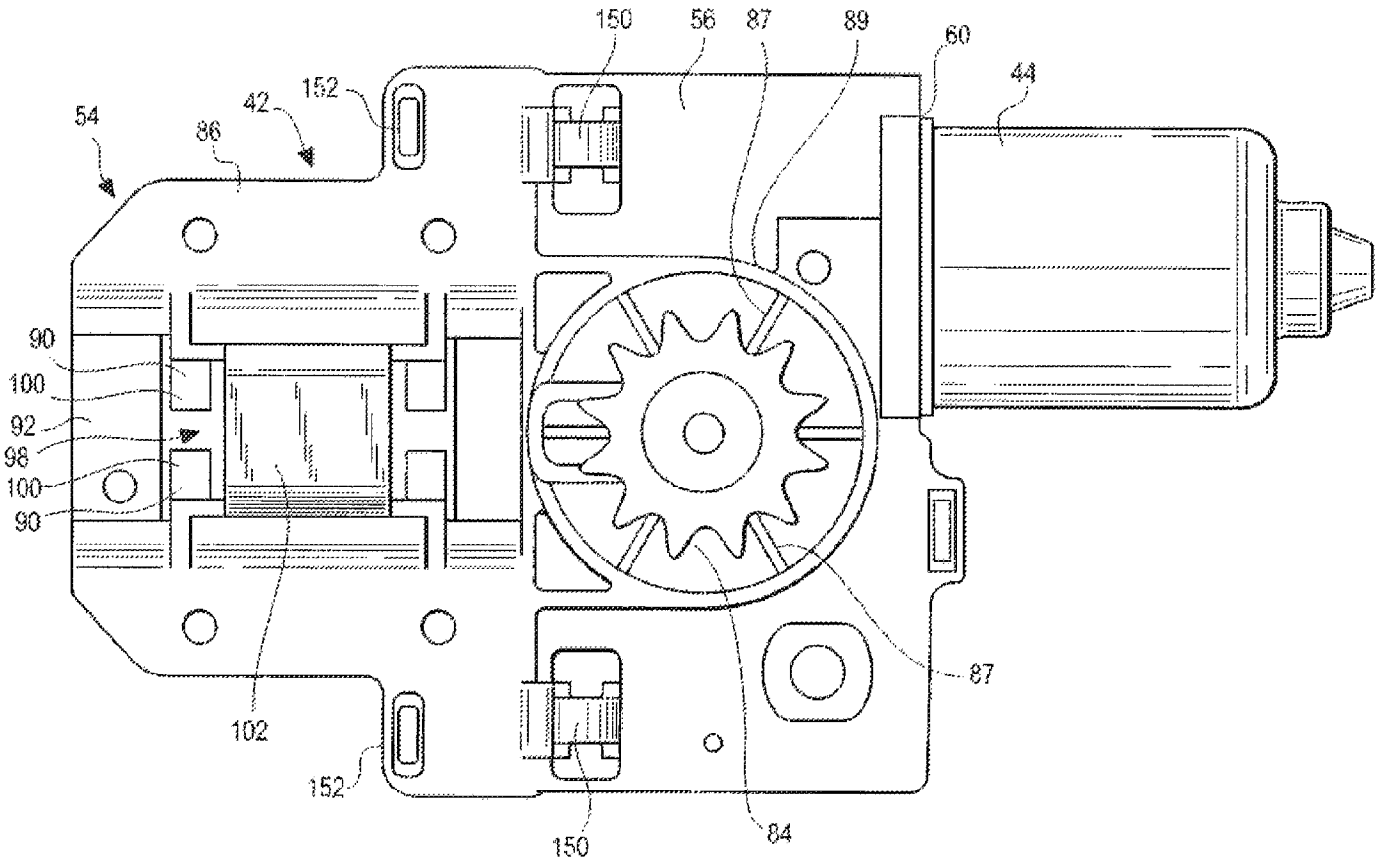
FIG. 3 is a bottom view of an example barrier operator chassis with a motor extending therefrom.
Figure 4:
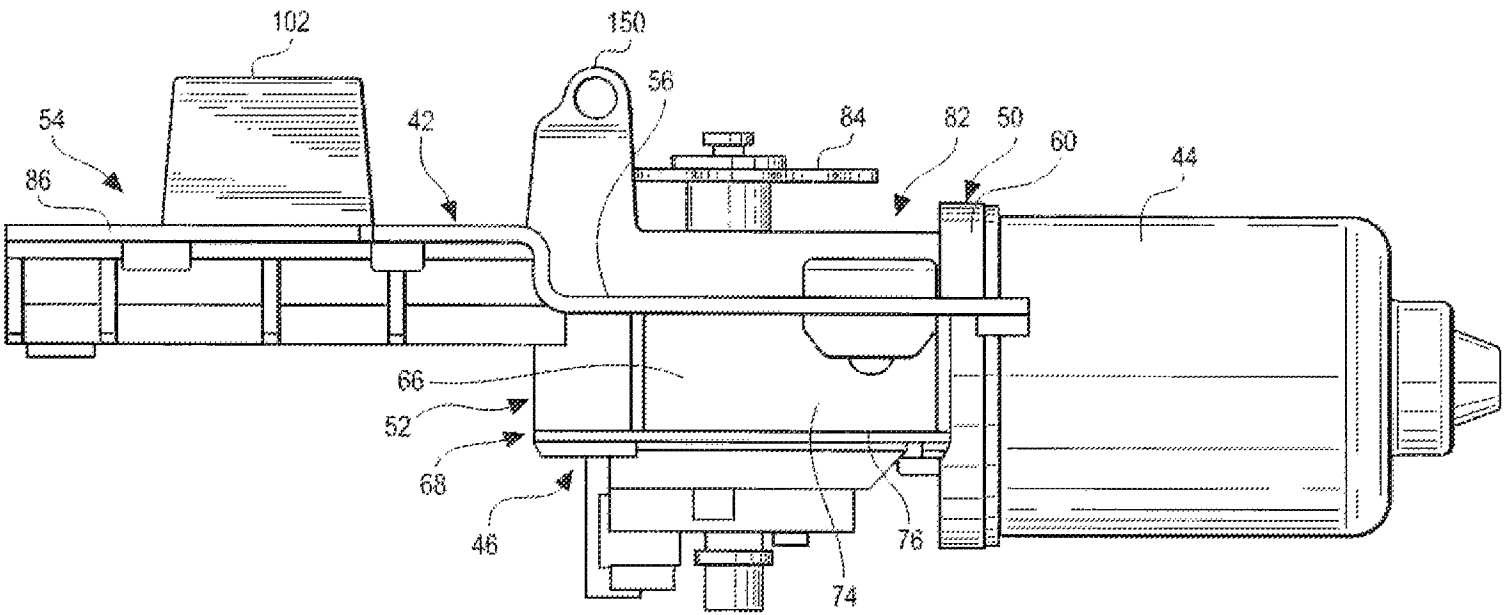
FIG. 4 is a side view of the barrier operator chassis of FIG. 3.
Figure 5:
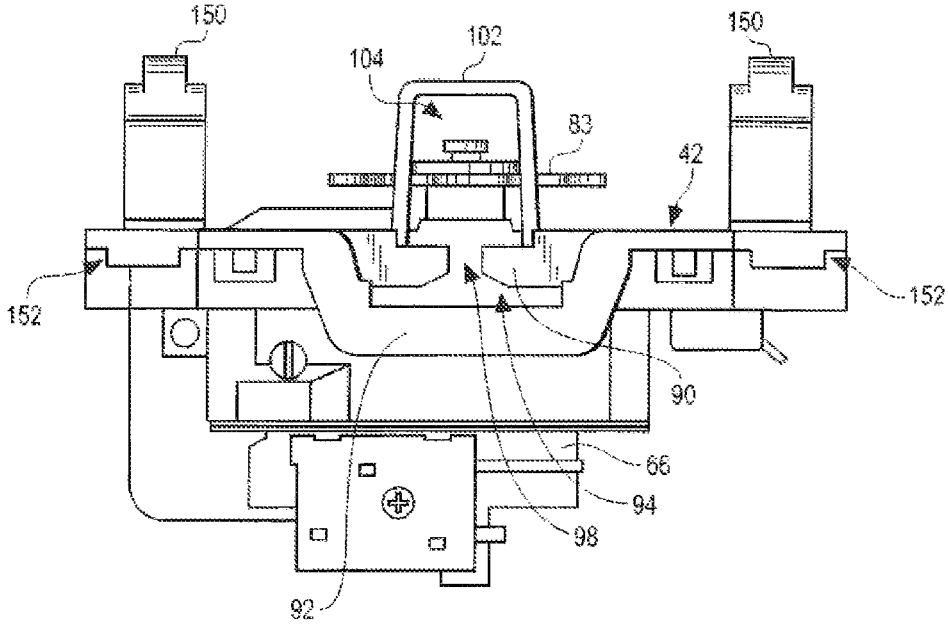
FIG. 5 is a front view of the barrier operator chassis of FIG. 3.

In one form, the C-shaped portion 102 may be used to help define one or more openings such as opening 104. For example, as shown in FIG. 2, the C-shaped portion 102, along with the arms 90 define opening 104. In this form, opening 104 is interconnected to opening 94 via slot 98. In this regard, one or more rail systems may be positioned in either and/or both of slots 104 and 98 and/or extend therebetween as will be described in more detail below.

In one form, the third portion 54 is configured to receive a plurality of different rail systems. In another form, the third portion 54 is configured to receive at least three different types of rail systems. For example, the illustrated third portion 54 is configured to receive any one of a T-rail system, a C-rail system, or an S SR system. These systems and their respective functionality with the barrier operator 20 will be described in more detail below with respect to FIGS. 6-8.

Figure 6:
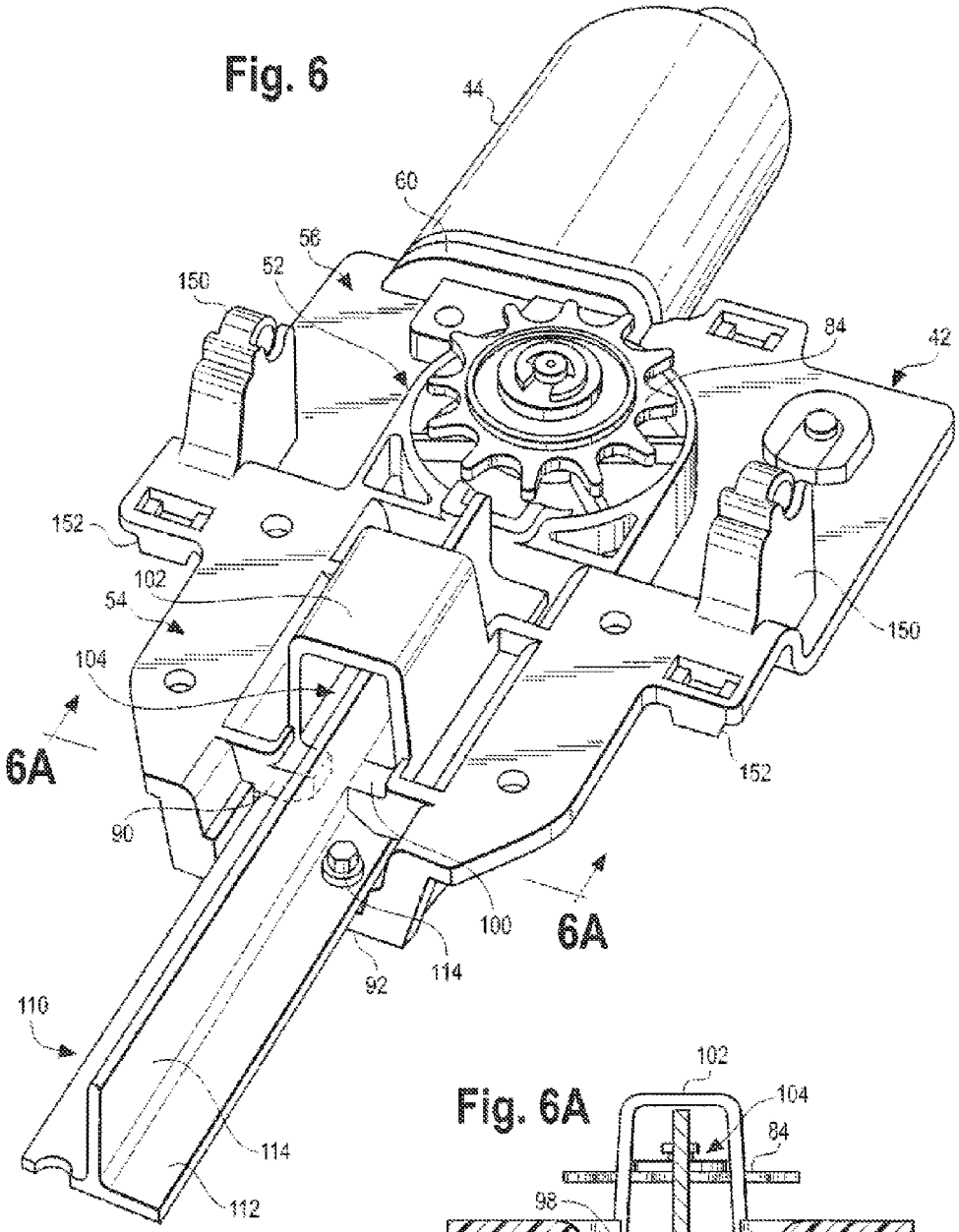
FIG. 6 is a perspective view of an example barrier operator and T-rail system.
Figure 6A:
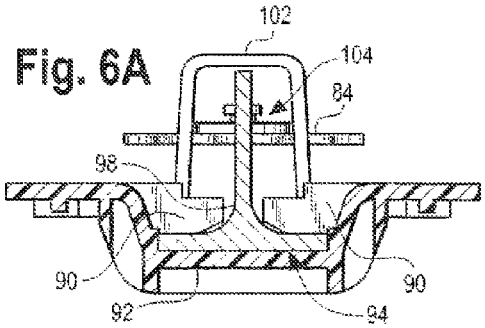
FIG. 6A is a cross-sectional view taken along line 6A-6A of FIG. 6.

Referring to FIGS. 6-6A, a portion of a T-rail system 110 is illustrated with the chassis 42. It should be understood that while a portion of the system, such as the track, is shown in these figures, other components such as the chain, belt, trolley, worm drive and/or other associated components would be included in the system 110. As seen in the figures, the T-rail system 110 generally includes a base portion 112 and a generally perpendicular portion 114. When installed on the chassis 42, the base portion 112 will generally extend through the opening 94 while the perpendicular portion 114 will extend through the slot 98 and into the opening 104. In this form, the lower flange 92 may be used to support and/or secure the base portion 112. Further, the arms 90 may be shaped and located such that they generally contact the base portion 112 and/or the perpendicular portion 114. The T-rail system 110 may be secured to the chassis 42 in any number of manners, such as, for example, by using screws or bolts 114. The T-rail system 110 may also be secured in other manners such as by welding and/or using adhesives.

Figure 7:
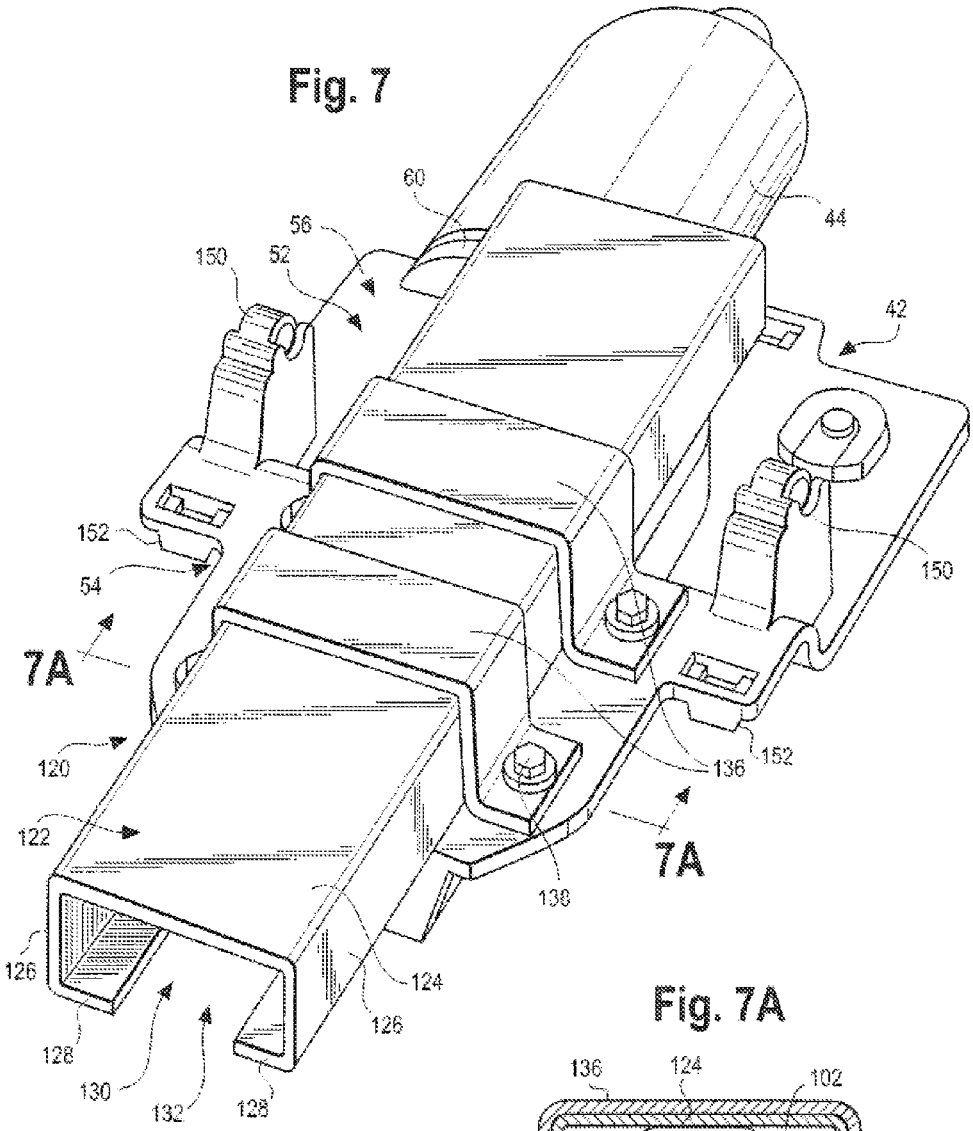
FIG. 7 is a perspective view of an example barrier operator and C-rail system.
Figure 7A:
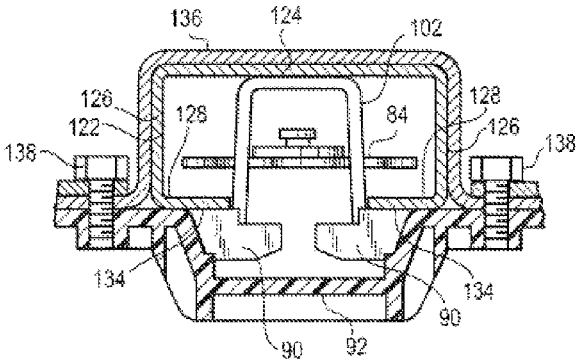
FIG. 7A is a cross-sectional view taken along line 7A-7A of FIG. 7.

Referring to FIGS. 7-7A, a portion of a C-rail system 120 is illustrated with the chassis 42. It should be understood that while a portion of the system is shown in these figures, other components such as the chain, belt, trolley, worm drive and/or other associated components would be included in the system 120. As seen in the figures, the C-rail system 120 generally includes a C-rail 122 having a base portion 124, two generally perpendicular portions 126 extending from opposite ends of the base portion 124 and two return portions 128 extending from the generally perpendicular portions and being substantially parallel to the base portion 124. The return portions 128 define a slot 130 while the base portion 124, perpendicular portions 126 and return portions 128 define an opening 132.

Generally, the return portions 128 are supported by the chassis 42 by second portion 54 and/or supports 134. The slot 130 is configured to be positioned about the C-shaped portion 102 and, in some instances, abut the C-shaped portion 102. Further, one or more devices, such as brackets 136, may be used to help secure the C-rail system 120 to the chassis 120. The brackets 136 may also be secured via bolts 138 such that the C-rail 122 may be secured between the C-shaped portion 102 and the brackets 136. Alternatively the C-rail system 120 may be directly secured to the chassis 42 such as by bolting or otherwise coupling the C-rail 122 directly to the chassis 42.

Figure 8:
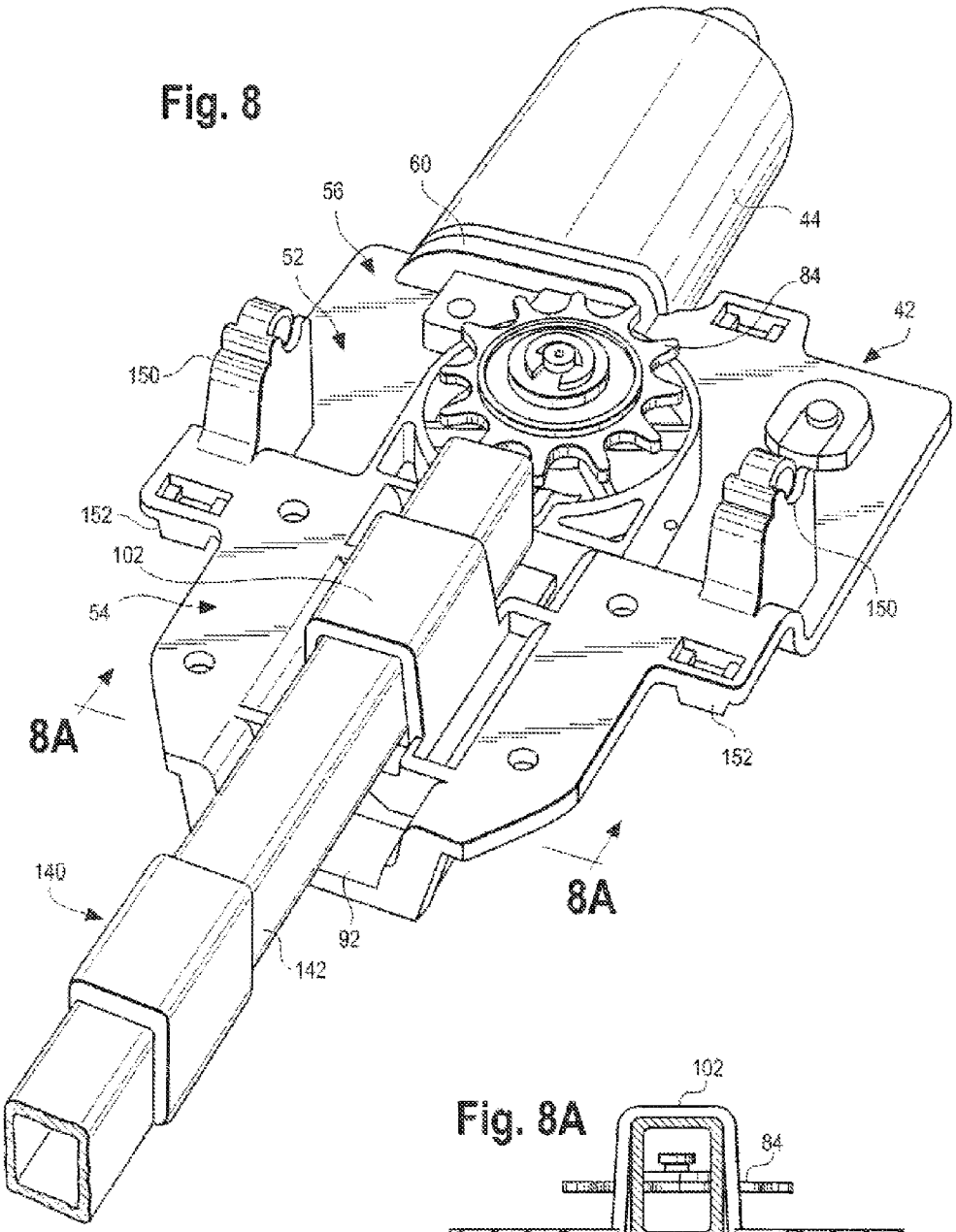
FIG. 8 is a perspective view of an example barrier operator and SSR system.
Figure 8A:
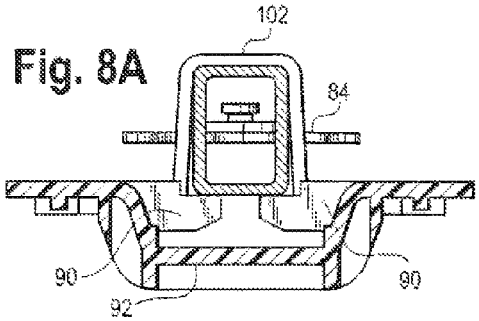
FIG. 8A is a cross-sectional view taken along line 8A-8A of FIG. 8.

Referring to FIGS. 8-8A, a portion of an SSR system 140 is illustrated with the chassis 42. It should be understood that while a portion of the system is shown in these figures, other components such as the chain, belt, trolley, worm drive, and/or other associated components would be included in the system 140. As seen in the figures, the SSR system 140 generally includes a substantially rectangular rail 142. The rail 142 is configured to be positioned in the opening 104 between the C-shaped portion 102 and the flanges 100 of the arms 90. It should be noted that the rail 142 may take other shapes and forms but is otherwise configured to be received in the opening 104.

The barrier operator 20 and chassis 42 may include additional features. For example, the chassis 42 may include one or more chassis mounts 150 to mount the chassis to an external structure, such as the ceiling of a garage. Further, the chassis 42 may include one or more body mounts 152 for mounting a body or enclosure 154 about the chassis 42. In one form, the body mounts 152 and the chassis mounts 150 may be the same structure or may be separate structures. Such mounts 150,152 may include holes for bolts, snap fit openings or protrusions and the like. In one form, the mounts 150,152 are integral with the chassis 42 such that they are formed as a single component.

Further, the barrier operator 20 may be configured to accept any number of different enclosures 154 (FIG. 1A). In this regard, the body mounts 152 may be positioned and configured such that the combined chassis 42 and enclosure 154 may be considered to be modular. In other words, the chassis 42 may accept any number of differently shaped and formed enclosures to thereby change the appearance of the barrier operator 20. The enclosures may be configured to partially or substantially completely enclose the barrier operator 20 and/or chassis 42.

In one form, the chassis 42 is an integral or unibody component. For example, in one form, the chassis 42 can be cast and/or molded as a single piece. Alternatively, the chassis 42 may be machined or otherwise manipulated from a single piece of material to include the features and structures described above. For example, the chassis 42 may be a single, unibody component including the first portion 50, the second portion 52, the third portion 54 and the mounts 150,152.

Furthermore, the chassis may be made from a variety of different materials. For example, the chassis may be made from plastics, metals, composites and the like. In one form, the chassis may be made from steel, aluminum, alloys, and the like.

It should be understood that the barrier operator may also include additional structures, supports, electronics, and the like generally associated with barrier operators and their functionality. For example, the barrier operator may include attachment points for electronics, such as wireless receiving equipment, power sources, data processors, and the like.

In one form, a barrier operator and/or chassis may be provided such that the barrier operator is substantially preassembled with the motor, transmission, and rail system receiving structure are already aligned and prepared for installation. Further, in one form, the barrier operator may be relatively compact. Additionally, in one form, the chassis may accept any of a plurality of different rail systems with a number of different openings designed to accommodate the different rail system without significant modification of the chassis.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. A chassis for a barrier operator, the barrier operator including a motor and a transmission configured to cooperate with a rail system to move a barrier, the chassis comprising:

a unibody frame, the unibody frame having a first portion configured to receive and secure the motor to the unibody frame, a second portion configured to receive and secure the transmission to the unibody frame, and a third portion configured to receive and secure at least a portion of the rail system to the unibody frame, the first, second and third portions being formed as a single, integral component, wherein the third portion includes a plurality of openings, recesses, or combinations thereof configured to receive a plurality of different rail systems, the third portion including a first opening configured to receive a first rail system and a second opening configured to receive a second rail system, the second rail system being different from the first rail system, the first and second rail openings being interconnected to allow a portion of the first rail system to extend from the first rail opening into the second rail opening.

2. The chassis of claim 1 further comprising at least one chassis mount positioned on the unibody frame and integral therewith to secure the chassis to an external structure.

3. The chassis of claim 1 further comprising at least one body mount positioned on the unibody frame and integral therewith to secure a body to the chassis to at least partially enclose the chassis.

4. The chassis of claim 1 wherein the second portion includes a cavity positioned on the unibody frame which receives and at least partially encloses the transmission.

5. The chassis of claim 1 wherein the unibody frame is one of cast or molded as a single, integral component.

6. A chassis for a barrier operator, the barrier operator including a motor and a transmission configured to cooperate with a rail system to move a barrier, the chassis comprising:

a frame, the frame having a first portion configured to receive and secure the motor to the frame, a second portion configured to receive and secure the transmission to the frame, and a third portion configured to receive and secure at least a portion of the rail system to the frame, the third portion including at least a first rail portion and a second rail portion, the first rail portion configured to receive and secure a first rail system to the chassis and the second rail portion configured to receive a second rail system different from the first rail system to the chassis, the first and second rail portions being formed as a single, integral component, wherein the third portion includes a plurality of openings, recesses, or combinations thereof configured to receive a plurality of different rail systems, the third portion including a first opening configured to receive a first rail system and a second opening configured to receive a second rail system, the second rail system being different from the first rail system, the first and second rail openings being interconnected to allow a portion of the first rail system to extend from the first rail opening into the second rail opening.

7. The chassis of claim 6 further comprising at least one chassis mount positioned on the unibody frame and integral therewith to secure the chassis to an external structure.

8. The chassis of claim 6 further comprising at least one body mount positioned on the unibody frame and integral therewith to secure a body to the chassis to at least partially enclose the chassis.

9. The chassis of claim 6 wherein the second portion includes a cavity positioned on the unibody frame which receives and at least partially encloses the transmission.

10. The chassis of claim 6 wherein the unibody frame is cast or molded as a single, integral component.

11. A barrier operator configured to cooperate with a rail system to move a barrier, the barrier operator comprising:

a motor;

a transmission; and a chassis, the chassis including a unibody frame having a first portion configured to receive and secure the motor to the unibody frame, a second portion configured to receive and secure the transmission to the unibody frame, and a third portion configured to receive and secure at least a portion of the rail system to the unibody frame, the first, second and third portions being formed as a single, integral component, wherein the third portion includes a plurality of openings, recesses, or combinations thereof configured to receive a plurality of different rail systems, the third portion including a first opening configured to receive a first rail system and a second opening configured to receive a second rail system, the second rail system being different from the first rail system, the first and second rail openings being interconnected to allow a portion of the first rail system to extend from the first rail opening into the second rail opening.

12. The barrier operator of claim 11 further comprising at least one chassis mount positioned on the unibody frame and integral therewith to secure the chassis to an external structure.

13. The barrier operator of claim 11 further comprising at least one body mount positioned on the unibody frame and integral therewith to secure a body to the chassis to at least partially enclose the chassis.

14. The barrier operator of claim 11 wherein the second portion includes a cavity positioned on the unibody frame which receives and at least partially encloses the transmission.

15. The barrier operator of claim 11 wherein the unibody frame is cast or molded as a single, integral component.

16. A barrier operator configured to cooperate with a rail system to move a barrier, the barrier operator comprising:

a motor;

a transmission; and a chassis, the chassis including a unibody frame having a first portion configured to receive and secure the motor to the unibody frame, a second portion configured to receive and secure the transmission to the unibody frame, and a third portion configured to receive and secure at least a portion of the rail system to the unibody frame, the third portion including at least a first rail portion defining a first rail opening and a second rail portion defining a second rail opening, the first rail opening configured to receive and secure a first rail system to the chassis and the second rail opening configured to receive a second rail system to the chassis different from the first rail system, the first and second rail openings being interconnected to allow a portion of the first rail system to extend from the first rail opening into the second rail opening, the first, second and third portions being formed as a single, integral component.

17. The barrier operator of claim 16 further comprising at least one chassis mount positioned on the unibody frame and integral therewith to secure the chassis to an external structure.

18. The barrier operator of claim 16 further comprising at least one body mount positioned on the unibody frame and integral therewith to secure a body to the chassis to at least partially enclose the chassis.

19. The barrier operator of claim 16 wherein the second portion includes a cavity positioned on the unibody frame which receives and at least partially encloses the transmission.

20. The barrier operator of claim 16 wherein the third portion includes a plurality of openings, recesses, or combinations thereof configured to receive a plurality of different rail systems.

21. The barrier operator of claim 16 wherein the unibody frame is cast or molded as a single, integral component.

22. The barrier operator of claim 16 wherein the first rail portion is configured to receive a T rail type rail for a barrier operator system.

23. The barrier operator of claim 16 wherein the second rail portion is configured to receive an SSR rail type rail for a barrier operator system.

24. The barrier operator of claim 20 further comprising a configuration of at least some of the plurality of openings, recesses, or combinations thereof configured to receive braces to define an opening configured to receive a C rail type rail for a barrier operator system.

25. The barrier operator of claim 24 wherein the first rail portion is configured to receive a T rail type rail for a barrier operator system.

26. The barrier operator of claim 25 wherein the second rail portion is configured to receive an SSR rail type rail for a barrier operator system.

27. The barrier operator of claim 24 wherein the first rail portion, the second rail portion, and the configuration of at least some of the plurality of openings, recesses, or combinations thereof are arranged such that rails connected to the chassis using the first rail portion, the second rail portion, or the configuration of at least some of the plurality of openings, recesses, or combinations thereof are connected to the chassis along a common axis.

28. The barrier operator of claim 27 wherein the first portion of the chassis is configured to secure a long axis of the motor parallel to the common axis of the rails.

29. The barrier operator of claim 28 wherein the second portion of the chassis is located between the first portion of the chassis and the third portion of the chassis.

30. An apparatus comprising:

a chassis comprising:

a first flange having a first flange edge, the first flange edge integral with and defining a motor flange formed to receive and mount a motor, the first flange having a transmission housing integral with and extending toward a first side of the chassis, the transmission housing configured to house at least a part of a transmission configured to receive rotational power from the motor and provide the rotational power to a drive gear supported on a second side of the chassis opposite of the first side of the chassis, the first flange defining an aperture configured to receive a portion of the transmission to drive the drive gear, a second flange integral with the first flange along an edge of the first flange different from the first flange edge, the second flange defining a pair of arms on the first side of the chassis, the pair of arms defining a slot between terminal portions of each of the arms, the slot configured to receive a first portion of a rail of a first rail system, the first portion of the rail of the first rail system when received in the slot being approximately perpendicular to the second flange, the second flange defining a support structure that together with the pair of arms defines an aperture configured to receive a second portion of the rail of the first rail system with the second portion of the rail of the first rail system oriented approximately parallel to the second flange and with an end of the rail of the first rail system approximately aligned with the drive gear, the second flange defining a C-shaped portion on the second side of the chassis, the C-shaped portion together with the pair of arms defining an aperture configured to receive the first portion of the rail of the first rail system and to engagingly receive a portion of a rail of a second rail system with an end of the rail of the second rail system approximately aligned with the drive gear.

31. The apparatus of claim 30 further comprising:

the motor; and the transmission.

32. The apparatus of claim 30 wherein the chassis defines body mount flanges that define body mount apertures configured to receive fasteners to fasten a body housing to the chassis.

33. The apparatus of claim 32 further comprising:

the motor;

the transmission; and the body housing.

34. The apparatus of claim 30 wherein the second flange defines openings, recesses, or combinations thereof configured to receive fasteners, a mounting bracket, or combinations thereof to together with at least a portion of the second flange define a rail mount aperture configured to receive a portion of a rail of a third rail system with an end of the rail of the third rail system approximately aligned with the drive gear.

35. The apparatus of claim 34 wherein the third rail system is a C rail type rail system.

36. The apparatus of claim 30 wherein the first rail system is a T rail type rail system.

37. The apparatus of claim 30 wherein the second rail system is an SSR rail type rail system.

* * * * *